United States Patent [19]

Sedlmair

[11] Patent Number: 5,060,966

[45] Date of Patent: Oct. 29, 1991

[54] SKI BRAKES FOR INTERLOCKING SKIS

[75] Inventor: Gerhard Sedlmair, Farchant, Fed. Rep. of Germany

[73] Assignee: Marker Deutschland GmbH, Fed. Rep. of Germany

[21] Appl. No.: 482,066

[22] Filed: Feb. 16, 1990

[30] Foreign Application Priority Data

Feb. 21, 1989 [DE] Fed. Rep. of Germany ... 8902049[U]

[51] Int. Cl.[5] ..... A63C 7/10

[52] U.S. Cl. ..... 280/605

[58] Field of Search ..... 280/605, 604, 814, 816, 280/815

[56] References Cited

U.S. PATENT DOCUMENTS

| | | | |
|---|---|---|---|
| 4,062,553 | 12/1977 | Riedel | 280/605 |
| 4,252,337 | 2/1981 | Luithlen | 280/814 |
| 4,304,420 | 12/1981 | Krob et al. | 280/814 |
| 4,688,820 | 8/1987 | Spitaler et al. | 280/605 |

FOREIGN PATENT DOCUMENTS

| | | | |
|---|---|---|---|
| 2412623 | 11/1975 | Fed. Rep. of Germany | 280/605 |
| 2726701 | 12/1978 | Fed. Rep. of Germany | 280/605 |
| 3136079 | 3/1983 | Fed. Rep. of Germany | 280/605 |
| 2357270 | 3/1978 | France | 280/605 |
| 2508325 | 12/1982 | France | 280/605 |
| 2580509 | 10/1986 | France | 280/605 |

*Primary Examiner*—Andres Kashnikow
*Assistant Examiner*—Eric Culbreth
*Attorney, Agent, or Firm*—D. Peter Hochberg; Mark Kusner; Louis J. Weisz

[57] ABSTRACT

Ski brakes useful in interlocking skis of a pair together comprising two shaped members having actuator and braking arm portions separated by an intermediate portion. The members are rotatably mounted in a base plate, the free ends of the actuator arm portions being axially aligned and connected by a coil spring, while the braking arms are provided with shoulders designed to engage longitudinal edges of the skis. To accomplish intelocking, the running surfaces of skis provided with the brakes are brought together in a face-to-face relationship, causing the braking arms on one of the skis to overlie the braking arms on the other ski. This results in bringing the shoulders of the brake of the latter ski into engagement with longitudinal edges of the former ski, thereby locking the skis together.

8 Claims, 1 Drawing Sheet

SKI BRAKES FOR INTERLOCKING SKIS

TECHNICAL FIELD

This invention relates to the interlocking together of skis of a pair. More particularly, this invention relates to ski brakes that interlock or hold skis together when the skis are not in use. Specifically, this invention relates to interlocking skis by bringing their running surfaces into face-to-face contact with each other, interlocking thereby being achieved by means of ski brakes at least one of which has braking arms that are provided with shoulders for engaging the other ski.

BACKGROUND OF THE INVENTION

Ski brakes capable of interlocking skis are known, for example, from the teachings of U.S. Pat. No. 4,062,553. Because the braking arms of such brakes desirably should not protrude from the sides of the skis during skiing, that is, their "overhang" should be minimized, and since the width of each ski of a pair is identical, a problem has heretofore existed as to how skis can be interlocked and held together with adequate reliability and without interference of their braking arms when the skis are placed next to each other.

In previously known interlocking braking structures, attempts have been made to solve the aforesaid problem by providing ski brakes characterized in having a certain elasticity relative to the transverse movement of their braking arms with respect to the skis' longitudinal axis. However, this approach has had the disadvantage that the braking arms of the ski brakes on adjacent skis tend to abrade the skis' edges as the braking arms are moved from their standby position to their operative position, and vice versa. The resulting abrasion is naturally undesirable for a number of reasons, including the fact that the skis suffer damage as a consequence thereof. Another disadvantage of such an approach resides in the fact that the skis must be offset along their longitudinal axis to accommodate their interlocking, a disposition that interferes with the skis' encasement for storage, or for transportation.

BRIEF DESCRIPTION OF THE INVENTION

In view of the preceding, therefore, it is a first aspect of this invention to hold skis together in interlocked pairs.

A second aspect of this invention is to allow skis of a pair to be held together by means of their attached ski brakes.

A further aspect of this invention is to provide an arrangement for holding skis together in pairs without objectionable offset along their longitudinal axis.

Another aspect of this invention is to allow skis arranged in pairs to be held together without additional components or cost.

Yet another aspect of this invention is to hold skis of a pair together without damaging the edges thereof due to abrasion of the ski edges by the braking arms of the ski brakes.

The foregoing and other aspects of the invention are provided by a ski brake that can cooperate with another such brake to interlock skis of a pair provided with such brakes comprising: two shaped members; spring means; and a base plate, wherein said shaped members include an actuator arm portion and a braking arm portion and are rotatably mounted in said base plate, the free ends of said actuator arm portions being connected by said spring means, and said braking arm portions being provided with engaging means adapted to lockingly engage skis, whereby when the running surfaces of the skis of said pair are brought into contact with each other, the braking arm portions of one of said ski brakes mounted on a first of said skis ovelies the braking arm portions of another of said ski brakes mounted on a second of said skis, causing the engaging means of the ski brake on said second ski to lockingly engage the first ski.

The foregoing and additional aspects of the invention are provided by a pair of skis brakes that functions to interlock skis of a pair together, such brakes comprising: two shaped members; a spring; and a base plate, wherein each of said shaped members includes an actuator arm portion, an intermediate portion, and a braking arm portion, said members being mounted and rotatable in said base plate in mirror image symmetry with the free ends of said actuator arm portions positioned in axial alignment adjacent to each other, said braking arm portions being movable between an inactive standby position, and an active braking position, and at least one ski brake of said pair having braking arms each of which is provided with at lest one shoulder therein adapted to engage the edge of a ski, and wherein said free ends of said actuator arm portions are connected together by said spring, whereby when one of said brakes is mounted on each ski of a pair and the skis' running surfaces are brought together in face-to-face relationship with the braking arms of said brakes extending athwart the longitudinal edges of the skis, the braking arm portions of a first of said ski brakes overlie the braking arm portions of a second of said ski brakes, thereby causing said shoulders of said second of said ski brakes to engage longitudinal edges of the ski attached to said first ski brake, resulting in the interlocking of said skis.

The foregoing and still other aspects of the invention are provided by a ski brake that can cooperate with another such brake to interlock skis of a pair together comprising: two shaped members; member sheaths; a coil spring; and a base plate, wherein each of the shaped members includes an actuator arm portion, an intermediate portion, and a braking arm portion, said members being mounted and rotatable in said base plate in mirror image symmetry with the free ends of said actuator arm portions positioned in axial alignment adjacent to each other, said braking arm portions being movable between an inactive standby position, and an active braking position, and each of said sheaths being provided with at least one shoulder adapted to engage the edge of a ski and being mounted on said braking arm portions, and wherein said free ends of said actuator arm portions are connected together by said coil spring, whereby when one of said brakes is mounted on each ski of a pair, and the skis' running surfaces are brought together in face-to-face relationship with the braking arms of said brakes extending athwart the longitudinal edges of the skis, the braking arm portions of a first of said ski brakes overlie the braking arm portions of a second of said ski brakes, thereby causing said shoulders of said second of said ski brakes to engage longitudinal edges of the ski attached to said first ski brake, resulting in the interlocking of the skis.

The foregoing and further aspects of the invention comprise a pair of skis each of which has a ski brake according to the preceding paragraph attached thereto.

BRIEF DESCRIPTION OF THE DRAWINGS

The invention will be better understood when reference is had to the following drawings in which like-numbers refer to like-parts, and in which.

DETAILED DESCRIPTION OF THE INVENTION

The interlocking of skis according to the invention is accomplished by providing the braking arms of the ski braking mechanisms on each of the skis with locking shoulders. During the interlocking action, the shoulders on the braking arms of the ski brake of one of the skis are brought into engaging contact with the edges of the other ski, interlocking the two skis together. In their interlocked position, the braking arms of the brake on a first of the skis overlie the braking arms of the brake on the second ski, forcing the braking arms of the second ski against the first ski in a position in which the shoulders on the braking arms of the second ski brake are brought into locking contact with the edges of the running surfaces of the first ski.

In carrying out the interlocking procedure, described more fully in the following, the running surfaces of the skis are placed together so that the somewhat divergent braking arms of the ski brake that are not intended to interlock with a ski will overlie and press against the braking arms of the ski brake that is intended to interlock with a ski. This causes the shoulders of the latter braking arms to engage and press against the edges of the latter ski, holding the two skis securely together with no longitudinal offset. The interlocked condition described permits the skis to be readily transported or stored, for example, in carrying bags, boxes and the like, when the skis are not in use.

The shoulders of the braking arms described are desirably fabricated at an oblique angle, relative to the longitudinal axis of the braking arms, so that the shoulders are positioned substantially parallel to the longitudinal axis of the ski when the braking arms are disposed in their active, or braking mode. This position allows the shoulders to be disposed substantially parallel to the edges of the adjacent ski, permitting the shoulders to engage the ski edges contiguously in the desired interlocking position.

Figure 2:
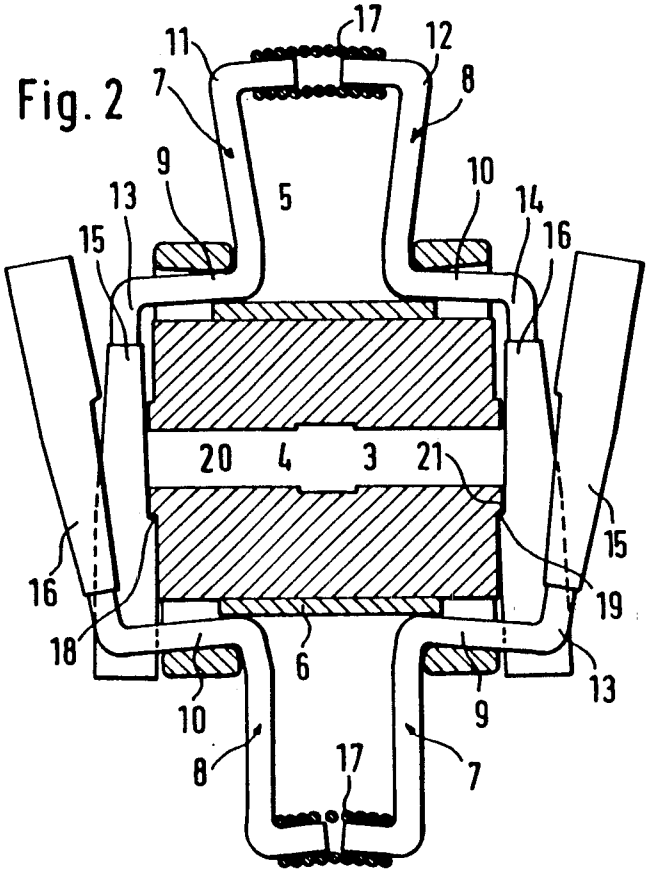
FIG. 2 is a cross-section of two skis held together by ski brakes of the invention, taken through the point of attachment of the ski brakes to the skis.
Figure 1:
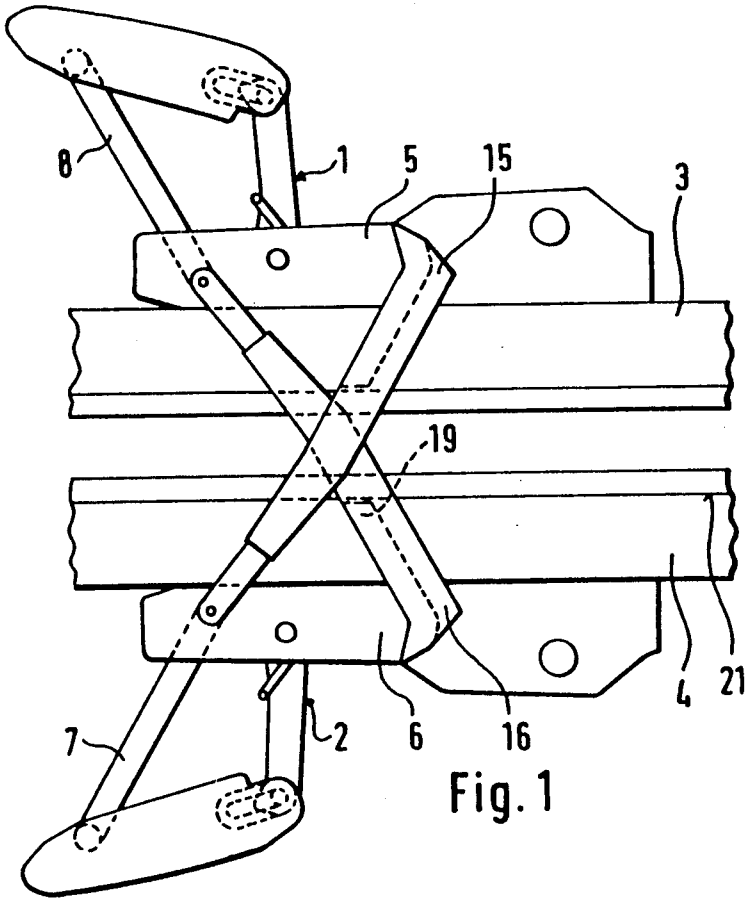
FIG. 1 is a partial side elevation of two skis held together by the improved ski brakes of the invention.

FIG. 1 illustrates a partial side elevation of two skis that are held together by the ski brakes of the invention, while FIG. 2 shows a cross-section of two skis held together by the ski brakes of the invention, the cross-section being taken through the point of attachment of the ski brakes to the skis.

In the Figures, ski brakes 1 and 2 are mounted respectively on skis 3 and 4, by means of base plates 5 and 6, respectively. If desired, the base plates may also have ski binding parts attached thereto.

Each of the ski brakes shown includes two shaped members, 7 and 8, disposed in a position exhibiting mirror image symmetry with respect to each other. The shaped members are typically fabricated from round wire or rods configured in the shape that can better be seen in FIG. 2. In effect, the shaped members 7 and 8 function as two-armed lever members, that revolve about their intermediate portions 9 and 10, respectively. Portions 11 and 12 of the shaped members comprise the actuating arms of the ski brakes, and portions 13 and 14 their braking arms. Each of the braking arms 13 and 14 is provided with a sheath, desirably fabricated from plastic, 15 and 16 respectively.

The free ends of the actuating arms 11 and 12 are angled toward each other and interconnected by a coil spring 17. Each of the sheaths is provided with locking shoulders 18 and 19, for respectively engaging edges 20 and 21 of a ski.

When the ski brakes 1 and 2 are in their operative braking position, the coil spring urges the free ends of the actuating arms 7 and 8 together, causing the braking arms 13 and 14 to diverge, as is shown with respect to the ski brake of the lower ski 4 of FIG. 2. When the brake is moved to its inactive, or standby position, the braking arms 13 and 14 are retracted toward each other against the force of the coil spring 17, the change being effected without contact between the braking arms and the sides of the skis.

As shown in FIG. 2, the ski braking arms 13 and 14 of the upper ski brake 1 have been forced into an innermost position by the pressure of the overlying ski braking arms of the ski brake of ski 4, which are in their outermost position. In such innermost position, the shoulders 18 and 19 of ski brake 1 are brought into locking engagement, respectively with edges 20 and 21 of ski 4, securely holding the skis 3 and 4 to each other.

When the ski brakes are in their operative braking position, the braking arms assume a position intermediate between the innermost and outermost positions described in connection with FIG. 2. In such intermediate position, sheaths 15 and 16 are urged apart by spring 17 so that shoulders 18 and 19 are disposed spaced from the edges of the ski, allowing the braking arms to be moved freely from their operative, braking position, to their standby position.

In effecting interlocking of the skis, the running surfaces of the skis are placed face-to-face with each other, and the ski whose edges are to be engaged is moved slightly longitudinally relative to the other ski, in the direction of the front of the skis. The moved ski is then moved backward toward the rear of the skis, causing the braking arms of the moved ski to overlie the braking arms of the other, stationary ski. The force thus generated by the overlying braking arms on the braking arms of the stationary ski causes the shoulders 18 and 19 of the stationary ski to move to their innermost position, and to engage edges 20 and 21 of the moved ski, resulting in the skis being interlocked together. When the running surfaces of the skis are juxtaposed to each other in the position described, the camber of the skis will cause the running surfaces of the skis to be spaced apart adjacent to their ski brakes, as shown in FIG. 2. As a consequence, and although more than one shoulder can be provided in each of sheaths 15 and 16 in order to accommodate the interlocking of skis of different thickness, multiple shoulders are not necessary when the distance between the running surfaces of the skis can be sufficiently varied by forcing the skis together against their somewhat elastic camber.

While the invention has been disclosed in relation to the locking engagement between the shoulders of the sheaths and the protruding steel edges 20 and 21, other edges can be used for the interlocking, for example, top edges provided in the skis, or the edges of a plate mounted on the skis.

Furthermore, the invention is not restricted to ski brakes of the type described herein, but may also be employed with other ski brakes having adequate elasticity transverse to the skis' longitudinal axis.

While in accordance with the patent statutes, a preferred embodiment and best mode has been presented, the scope of the invention is not limited thereto, but rather is measured by the scope of the attached claims.

What is claimed is:

1. A ski brake that cooperates with another such brake to interlock skis of a pair provided with such brakes together comprising:

two bent brake members, and spring means, wherein said brake members include an actuator arm portion having a free end and a braking arm portion and are rotatably mountable in a base plate fixed to a ski, said bent brake members being mountable on opposite sides of a ski in mirror image relationship with said free ends of said actuator arm portions being connected by said spring means to urge said braking arm portions outwardly apart, said braking arm portions being provided with a recessed shoulder surface oblique to the longitudinal axis of said braking arm portions and facing inwardly toward the ski adapted to lockingly engage the other of the pair of skis, and wherein the braking arm portions of one of said ski brakes mounted on a first of the pair of skis overlie the braking arm portions of another of said ski brakes mounted on a second of the pair of skis, causing the recessed shoulder surfaces of the ski brake on said other ski to overlie and lockingly engage side edges of the first ski against the urging of said spring means when the running surfaces of the skis of said pair are brought into contact with each other.

2. A ski brake that cooperates with another such brake to interlock a pair of skis together, said ski brake comprising:

two bent brake members, member sheaths, and a coil spring, wherein each of said bent brake members includes an actuator arm portion having a free end, an intermediate portion, and a braking arm portion, said members being mountable on opposite sides of a ski in mirror image symmetry and rotatable in a base plate fixed to said skis with the free ends of said actuator arm portions positioned in axial alignment adjacent to each other, said braking arm portions being movable between an inactive standby position, and an active braking position, and each of said sheaths being provided with at least one recessed shoulder surface oblique to the longitudinal axis of said braking arm portion and facing inwardly toward the ski adapted to overlie and engage the edge of a ski against the urging of said spring, said sheaths being mounted on said braking arm portions, and wherein said free ends of said actuator arm portions are connected together by said coil spring, said spring urging said braking arm portions outwardly, and when one of said brakes is mounted on each ski of a pair and the skis' running surfaces are brought together in face-to-face relationship with the braking arms of said brakes extending athwart the longitudinal edges of the skis, the braking arm portions of the first of said ski brakes overlie the braking arm portions of a second of said ski brakes, causing said recessed shoulder surfaces of said second of said ski brakes to overlie and lockingly engage longitudinal edges of the ski attached to said first ski brake, resulting in the interlocking of said skis.

3. A pair of ski brakes that functions to interlock skis of a pair together, each brake comprising:

two bent brake members, and a spring, wherein each of said bent brake members includes an actuator arm portion having a free end, an intermediate portion, and a braking arm portion, said members being mountable on opposite sides of a ski in mirror image symmetry and rotatable in a base plate fixable to said skis with the free ends of said actuator arm portions positioned in axial alignment adjacent to each other and connected by said spring, said spring urging said braking arm portions outwardly, and said braking arm portions being movable between an inactive standby position, and an active braking position, and the ski brakes of said pair having braking arms each of which is provided with at least one recessed shoulder surface oblique to the longitudinal axis of said braking arms and facing inwardly toward the ski adapted to overlie and lockingly engage the running edge of an adjacent ski against the urging of said spring, and when the skis running surfaces are brought together in face-to-face relationship with the braking arms of said brakes extending athwart the longitudinal edges of the skis, the braking arm portions of a first of said ski brakes overlies the braking arm portions of a second of said ski brakes, causing said recessed shoulder surfaces of said second of said ski brakes to overlie and lockingly engage the longitudinal running edges of the ski attached to said first ski brake, resulting in the interlocking of said skis.

4. A ski brake according to claim 3 attached to a ski.

5. A ski brake mountable on one of a pair of skis that cooperates with another such ski brake mounted on the second of a pair of skis for interlocking the skis together, the ski having a running surface and a pair of opposing side edges; said ski brake comprising:

base plate means;

a pair of bent members, each member including a resilient braking arm, mounted in a mirror image symmetry on opposite sides of said base plate means for movement to position each of said braking arms in active braking position wherein said braking arms are disposed beneath the running surfaces of the ski and an inactive standby position wherein said braking arms are above the running surface of the ski when said ski brake is attached to a ski, each of said braking arms having a longitudinal axis and an inside portion facing the other braking arm of said pair of bent members; and biasing means biasing said braking arms of said pair of bent members outwardly away from each other;

one pair of said braking arms overlapping the braking arms of the other such pair of braking arms of a like ski brake when said ski brakes are brought together with their braking arms extending towards each other, to overcome the biasing means of the overlapped pair of braking arms and move said overlapped pair towards each other and urge the inside portion of the overlapped pair of braking arms against the opposing side edges of a ski on which said overlapping pair is mounted to interlock the skis together.

6. A ski brake of claim 5 and further including a recessed shoulder on the inside surfaces of said brake arms, said shoulders being engageable with the opposing side edges of the other of the pair of skis on which the ski brakes are mounted when the brake arms having said shoulders are moved inwardly by the overlapping brake arms, to interlock the skis together.

7. A ski brake according to claim 6 in which the ski brake has a front direction facing towards the front of a ski on which said ski brake is mountable, and wherein the shoulder of at least one of said braking arms are positioned at an oblique angle relative to the longitudinal axis of said braking arm.

8. A ski brake according to claim 7 in which said shoulders are parallel to each other when they are in locking engagement with the pair of skis on which they are mounted.

* * * * *